US007448634B1

(12) United States Patent
Raub

(10) Patent No.: US 7,448,634 B1
(45) Date of Patent: Nov. 11, 2008

(54) COLLAPSIBLE DISPLAY RACK

(76) Inventor: Bart Raub, 722 S. Ranger Blvd., Winter Park, FL (US) 32792

( * ) Notice: Subject to any disclaimer, the term of this patent is extended or adjusted under 35 U.S.C. 154(b) by 344 days.

(21) Appl. No.: 11/376,592

(22) Filed: Mar. 16, 2006

(51) Int. Cl.
*B62B 5/00* (2006.01)
*A47F 5/00* (2006.01)

(52) U.S. Cl. ..... 280/79.3; 280/87.05; 280/47.18; 280/79.7; 280/33.996; 108/108; 211/133.3; 211/186; 211/187; 211/188; 211/189; 211/181.1

(58) Field of Classification Search ..... 280/33.991, 280/87.05, 47.18, 79.3, 79.7, 33.997, 33.998, 280/35, 639; 211/186, 187, 189, 190, 194, 211/181.1; 108/108
See application file for complete search history.

(56) References Cited

U.S. PATENT DOCUMENTS 3,857,494 A * 12/1974 Giardini ..... 211/194
3,908,562 A * 9/1975 Wittschen ..... 280/79.11
4,045,043 A 8/1977 Fourrey
4,097,097 A 6/1978 Hosko
4,127,196 A 11/1978 Boucher
4,509,805 A 4/1985 Welsch et al.
4,586,618 A 5/1986 Norman
4,784,205 A * 11/1988 Johnson et al. ..... 160/351
4,884,702 A 12/1989 Rekow
4,915,462 A 4/1990 Le Marchand et al.
5,253,770 A 10/1993 Rosenthal
5,255,803 A 10/1993 Pavone et al.
5,566,844 A * 10/1996 Bernardin ..... 211/189
5,607,070 A * 3/1997 Hellyer ..... 211/189
D400,361 S 11/1998 Sobrito
5,918,750 A * 7/1999 Jackson ..... 211/189
6,029,833 A * 2/2000 Yeh ..... 211/189
6,164,467 A * 12/2000 DePottey et al. ..... 211/189
6,669,213 B2 * 12/2003 Woerner ..... 280/47.35
7,270,242 B2 * 9/2007 Liu ..... 211/189
2001/0013690 A1 * 8/2001 Sexton et al. ..... 280/79.7
2005/0000924 A1 * 1/2005 Webb ..... 211/59.2

* cited by examiner

*Primary Examiner*—Christopher P Ellis
*Assistant Examiner*—Jacob Meyer

(57) ABSTRACT

A display rack has a longitudinal axis, and includes vertically stacked and coextensive grid members that are removably connectable. Each grid member has a pair of oppositely spaced arms equidistantly spaced from and parallel to the axis and further includes a mesh patterned central body that spans across a distance between the arms. A mechanism is included for supporting the grid members at both a vertically stacked position and a vertically non-stacked position. The grid member supporting mechanism is completely detachable from the grid members and is independently transportable therewith. The arms are connected to each other when the grid members are stacked and are disconnected when the grid members are not stacked. Selected arms have male and female portions. The male portions are telescopically conjoined with the female portions when the grid members are stacked.

3 Claims, 7 Drawing Sheets

COLLAPSIBLE DISPLAY RACK

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to display racks and, more particularly, to a collapsible display rack for supporting a plurality of items at an elevated position.

2. Prior Art

Display racks for displaying merchandise for sale are in wide use. A typical application of such a display rack is in the area of supermarket check-out counters where a large number of display racks are usually provided for displaying merchandise such as magazines. Typically, such a display rack includes a perforated panel held in a substantially vertical plane by side support members. Magazines pockets are then supported on the panel by means of hooks on the pockets which are adapted to fit through the panel perforations.

One of the problems associated with conventional display rack construction is the fact that conventional display racks have in the past been constructed of a fixed size. If it is desired to change the size of the display rack, such as to add more magazine pockets, or use larger pockets, the entire display rack has to be replaced. This is extremely inefficient because either the merchandising establishment or the display rack distributor has to stock a large number of display racks of different sizes. Furthermore, as a need arises to store certain display racks, the fixed and awkward shapes thereof greatly increases the difficulty with which the racks can be stored.

Accordingly, a need remains for a collapsible display rack in order to overcome the above-noted shortcomings. The present invention satisfies such a need by providing a display rack that is easy and convenient to use, light weigh and durable in design, adjustable in size, and allows for quick compact storage of the assembly. Such a display rack assembly eliminates the frustrations and problems associated with transporting and storing the conventional bulky and upright display racks often employed when advertising merchandise to the public. The casters provided with the assembly also greatly reduce the effort needed to transport a display rack between remote locations. Such a collapsible display rack assembly is greatly appreciable by various commercial and privately owned businesses.

BRIEF SUMMARY OF THE INVENTION

In view of the foregoing background, it is therefore an object of the present invention to provide a collapsible display rack. These and other objects, features, and advantages of the invention are provided by a collapsible display rack for supporting a plurality of items at an elevated position.

The display rack has a centrally registered longitudinal axis extending therethrough. Such a display rack includes a plurality of vertically stacked and coextensively shaped grid members that are removably connectable to each other respectively. Each of the grid members has a pair of oppositely spaced arms equidistantly spaced from the axis and extends parallel thereto. Each of the grid members further includes a central body that has a mesh pattern. Each of the central bodies is intermediately spaced between associated ones of the arms such that each of the central bodies effectively spans across an entire distance between the arms respectively.

The arms are directly connected to each other when the grid members are adapted to the stacked position. Such arms are disconnected from each other when the grid members are adapted to the non-stacked position. Selected ones of the arms have monolithically formed male and female portions formed therein. The male portions are telescopically and removably conjoined directly with the female portions when the grid members are adapted to the stacked position.

A mechanism is included for supporting the grid members at both a vertically stacked position and a vertically non-stacked position such that each of the grid members can advantageously and conveniently be stored and transported at the non-stacked position during transport. Such a grid member supporting mechanism is completely detachable from the grid members and is independently transportable therewith.

The grid member supporting mechanism preferably includes a base member that has a plurality of rectilinear and elongated leg members oppositely and equidistantly spaced from the axis. Such leg members are disposed parallel to each other and are further oriented parallel to a ground surface. The base member further has a plurality of casters directly conjoined to axially opposed end portions of each of the leg members respectively such that the leg members effectively remain equidistantly spaced above the ground surface during operating conditions. Such a base member also has a pair of oppositely seated central brackets that are directly connected to the leg members and are medially seated therealong respectively.

The base member further has a stabilizing lever that has an elongated and rectilinear shape provided with axially opposed end portions that are directly conjoined to the leg members respectively. Such a stabilizing lever traverses the axis. The base member further includes a plurality of upwardly and inwardly protruding flanges monolithically formed with the leg members that are spaced adjacent to the end portions thereof. Such flanges are suitably sized and shaped for receiving the grid members therebetween such that the grid members are effectively and conveniently maintained at vertical positions and remain directly rested upon the leg members during non-operating conditions.

In an alternate embodiment, the grid member supporting mechanism may include a base member that includes a plurality of coextensively shaped leg members that are equidistantly spaced from the axis and are oriented perpendicular thereto. A pair of oppositely facing walls are directly conjoined to the leg members and are equidistantly spaced from the axis. A bottom surface spans across an entire surface area between the walls and the leg members. Such a bottom surface includes a plurality of rectilinear support rails that are oriented parallel to the leg members and are directly connected to the walls.

A plurality of central brackets are directly attached to the leg members respectively and extend vertically upward therefrom. The bottom surface is suitably sized and shaped for receiving the grid members thereon such that the grid members can advantageously and effectively be stacked along a horizontal plane and parallel to the ground surface during non-operating conditions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
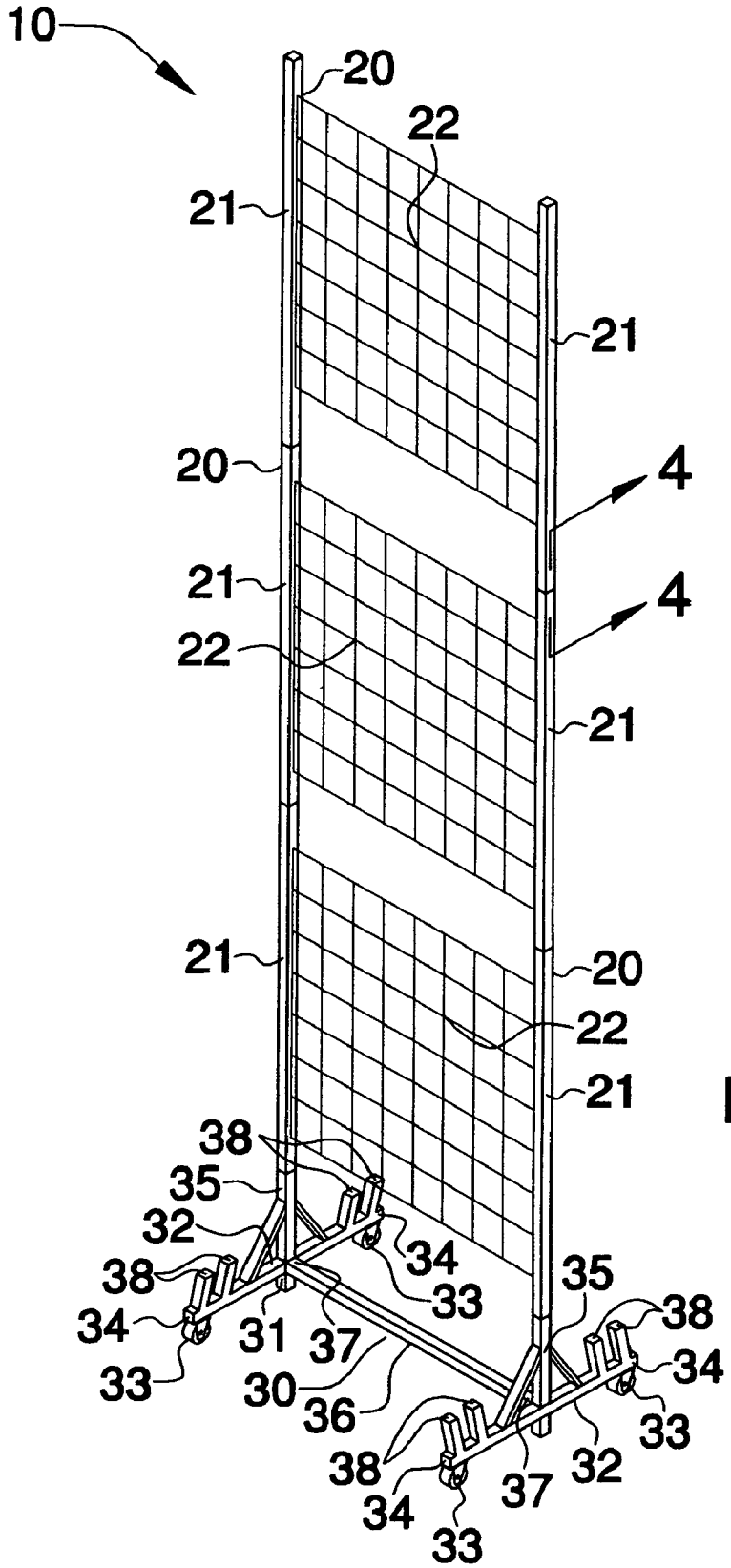
FIG. 1 is a perspective view showing a collapsible display rack, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime and double prime numbers refer to alternate embodiments of such elements.

The assembly of this invention is referred to generally in FIGS. 1-7 by the reference numeral 10 and is intended to provide a collapsible display rack. It should be understood that the assembly 10 may be used to display many different types of items and should not be limited in use to the display of only garments.

Figure 2:
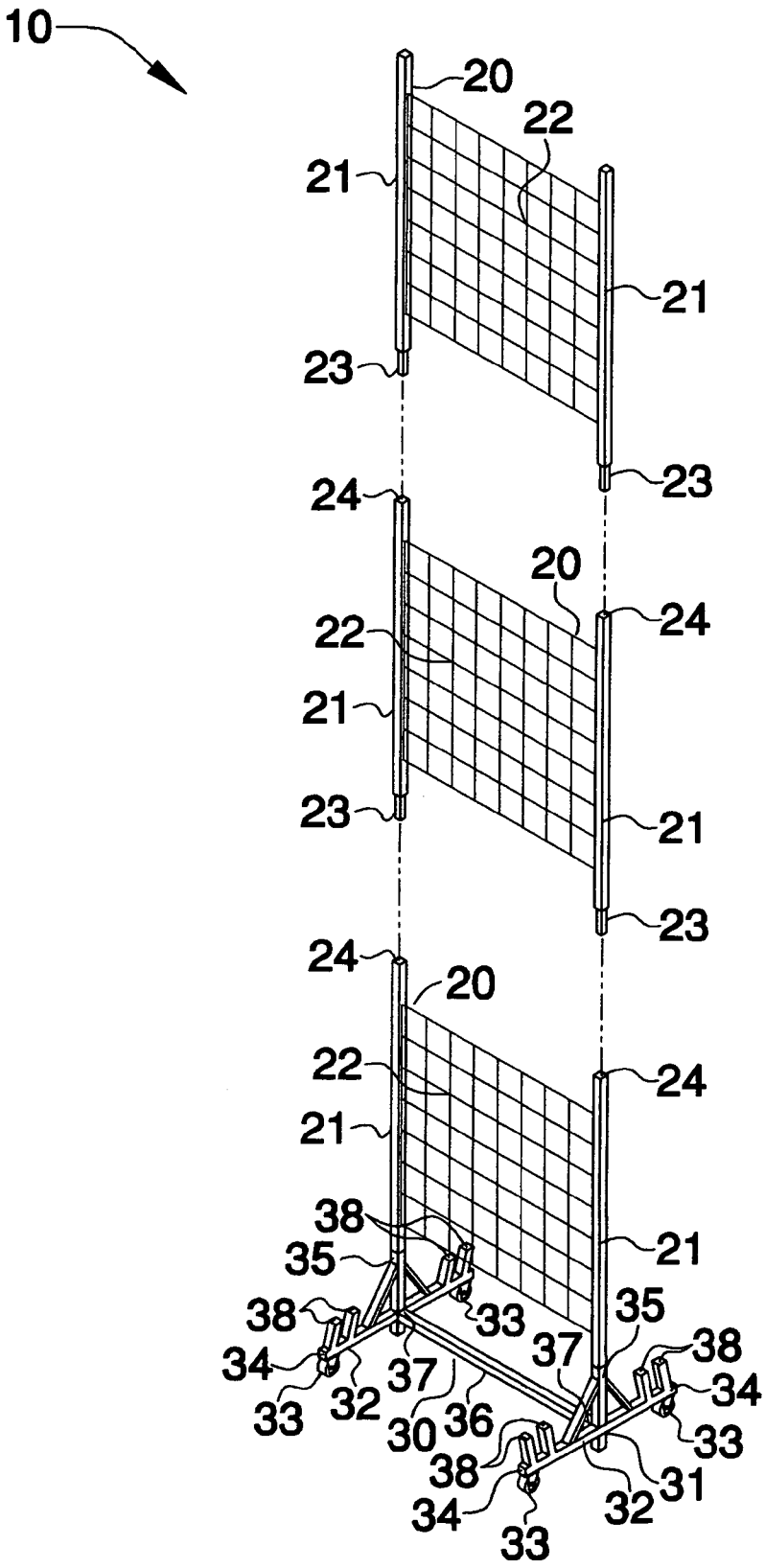
FIG. 2 is an exploded perspective view of the assembly shown in FIG. 1.

Referring initially to FIGS. 1 and 2, the assembly 10 includes a centrally registered longitudinal axis extending therethrough. Such a display rack 10 includes a plurality of vertically stacked and coextensively shaped grid members 20 that are removably connectable to each other respectively. Each of the grid members 20 has a pair of oppositely spaced arms 21 equidistantly spaced from the axis and extends parallel thereto. Each of the grid members 20 further includes a central body 22 that has a mesh pattern. Each of the central bodies 22 is intermediately spaced between associated ones of the arms 21, which is essential such that each of the central bodies 22 effectively spans across an entire distance between the arms 21 respectively.

Figure 3:
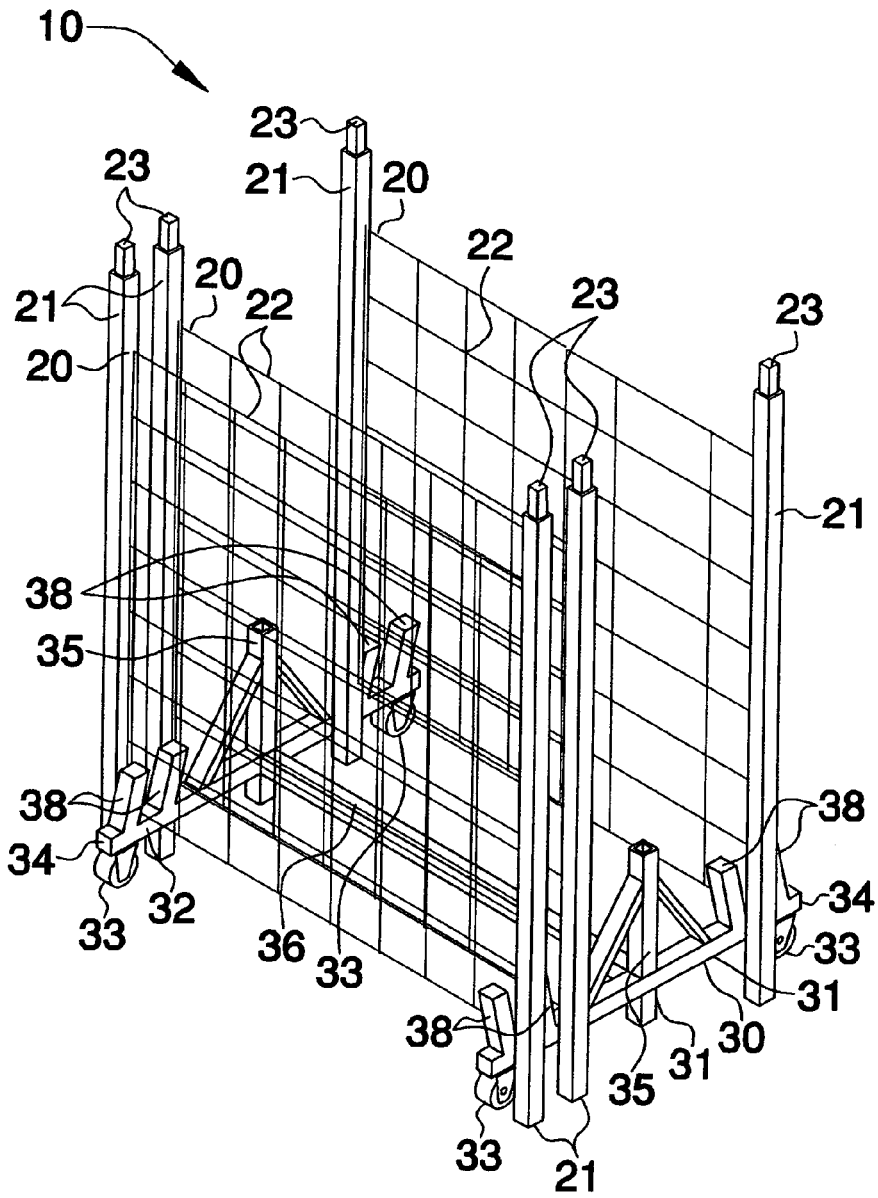
FIG. 3 is a perspective view of the assembly shown in FIG. 1, showing the grid members non-stacked position suitable for transport and storage.
Figure 4:
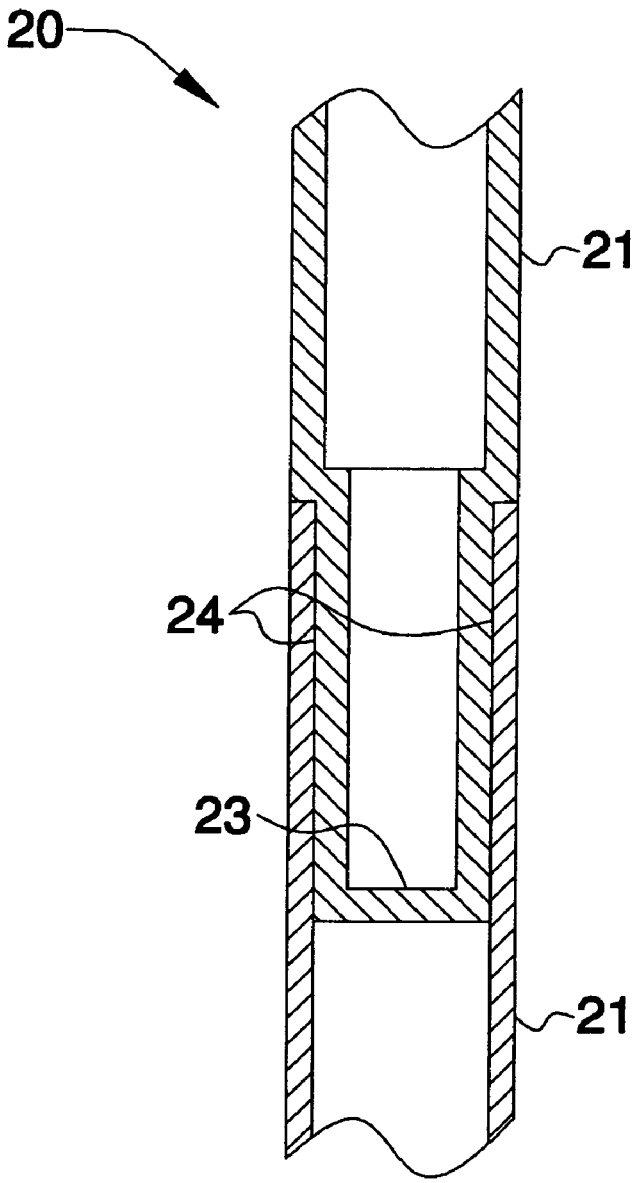
FIG. 4 is a cross-sectional view of the assembly shown in FIG. 1, taken along line 4-4.

Referring to FIGS. 1 through 4, the arms 21 are directly connected, without the use of intervening elements, to each other when the grid members 20 are adapted to the stacked position, as is best shown in FIG. 1. Such arms 21 are disconnected from each other when the grid members 20 are adapted to the non-stacked position, as is illustrated in FIG. 3. Selected ones of the arms 21 have monolithically formed male 23 and female 24 portions formed therein. The male portions 23 are telescopically and removably conjoined directly, without the use of intervening elements, with the female portions 24 when the grid members 20 are adapted to the stacked position.

Referring to FIGS. 1 through 3, a mechanism 30 is included for supporting the grid members 20 at both a vertically stacked position and a vertically non-stacked position such that each of the grid members 20 can advantageously and conveniently be stored and transported at the non-stacked position during transport. Such a grid member supporting mechanism 30 is completely detachable from the grid members 20 and is independently transportable therewith. The grid member supporting mechanism 30 includes a base member 31 that has a plurality of rectilinear and elongated leg members 32 oppositely and equidistantly spaced from the axis. Such leg members 32 are disposed parallel to each other and are further oriented parallel to a ground surface.

Still referring to FIGS. 1 through 3, the base member 31 further has a plurality of casters 33 directly conjoined, without the use of intervening elements, to axially opposed end portions 34 of each of the leg members 32 respectively such that the leg members 32 effectively remain equidistantly spaced above the ground surface during operating conditions. Such a base member 31 also has a pair of oppositely seated central brackets 35 that are directly connected, without the use of intervening elements, to the leg members 32 and are medially seated therealong respectively.

The base member 31 further has a stabilizing lever 36 that has an elongated and rectilinear shape provided with axially opposed end portions 37 that are directly conjoined, without the use of intervening elements, to the leg members 32 respectively. Such a stabilizing lever 36 traverses the axis. The base member 31 further includes a plurality of upwardly and inwardly protruding flanges 38 that are monolithically formed with the leg members 32 and are spaced adjacent to the end portions 34 thereof. Such flanges 38 are suitably sized and shaped for receiving the grid members 20 therebetween, which is crucial such that the grid members 20 are effectively and conveniently maintained at vertical positions and remain directly rested, without the use of intervening elements, upon the leg members 32 during non-operating conditions.

Figure 5:
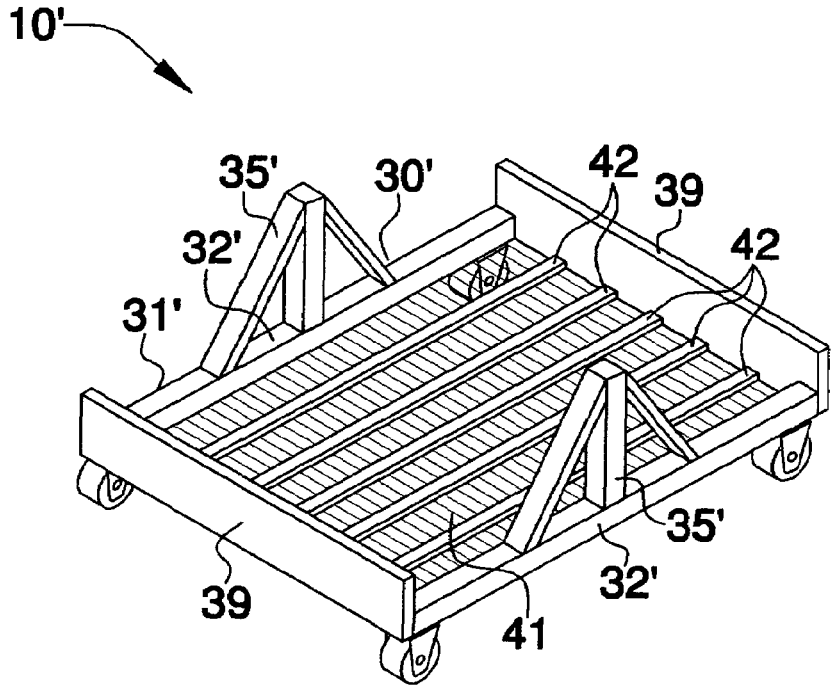
FIG. 5 is a perspective view showing an alternate embodiment of the base member shown in FIGS. 1 through 3, in accordance with the present invention.
Figure 6:
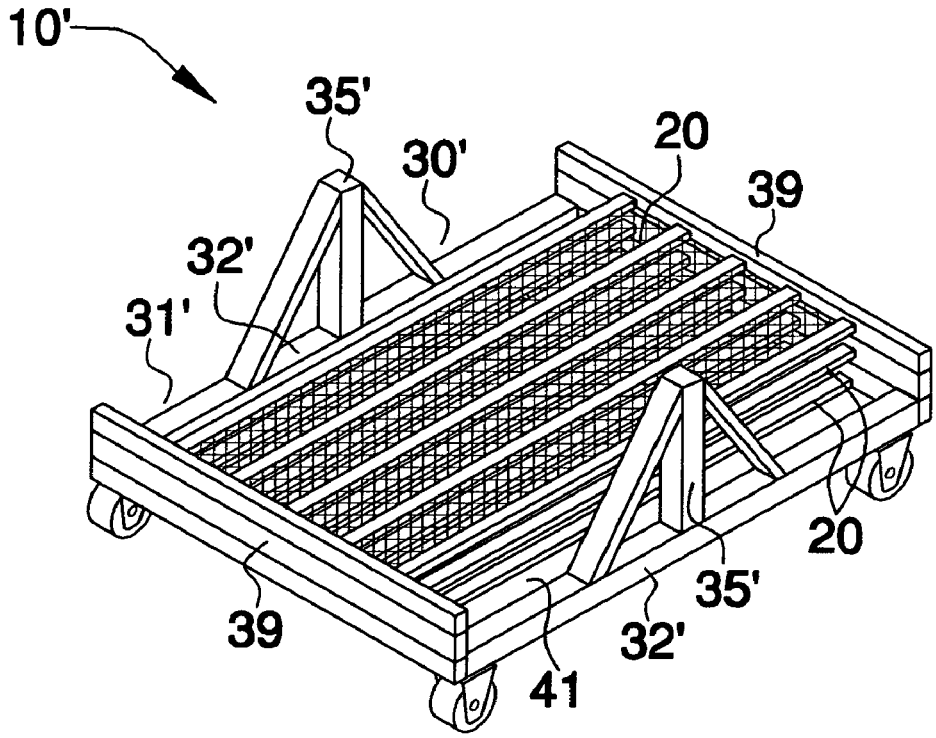
FIG. 6 is a perspective view of the base member shown in FIG. 5, showing the grid members stored thereon.

Referring to FIGS. 5 and 6, in an alternate embodiment 10', the grid member supporting mechanism 30' includes a base member 31' that includes a plurality of coextensively shaped leg members 32' that are equidistantly spaced from the axis and are oriented perpendicular thereto. A pair of oppositely facing walls are 39 directly conjoined, without the use of intervening elements, to the leg members 32' and are equidistantly spaced from the axis.

A bottom surface 41 spans across an entire surface area between the walls 39 and the leg members 32'. Such a bottom surface 41 includes a plurality of rectilinear support rails 42 that are oriented parallel to the leg members 32' and are directly connected, without the use of intervening elements, to the walls 39. A plurality of central brackets 35' are directly attached, without the use of intervening elements, to the leg members 32' respectively and extend vertically upward therefrom. The bottom surface 41 is suitably sized and shaped for receiving the grid members 20 thereon, which is important such that the grid members 20 can advantageously and effectively be stacked along a horizontal plane and parallel to the ground surface during non-operating conditions.

Figure 7:
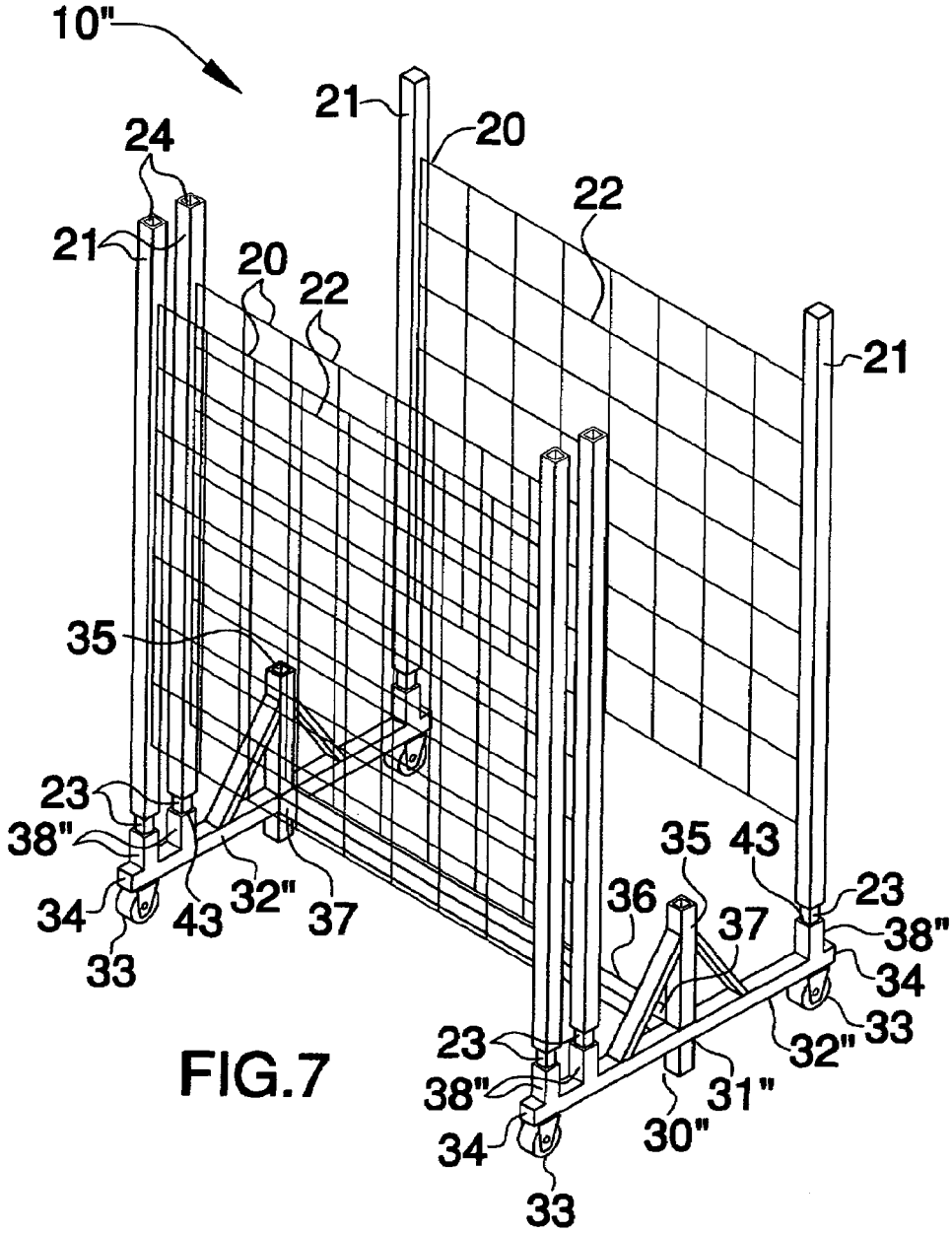
FIG. 7 is a perspective view showing another embodiment of the base member shown in FIGS. 1 through 3, in accordance with the present invention.

Referring to FIG. 7, in another embodiment 10", the grid member supporting mechanism 30" includes a base member 31" that has a plurality of rectilinear and elongated leg members 32" oppositely and equidistantly spaced from the axis. Such leg members 32" are disposed parallel to each other and are further oriented parallel to a ground surface. The base member 31" further has a plurality of casters 33 directly conjoined, without the use of intervening elements, to axially opposed end portions 34 of each of the leg members 32" respectively such that the leg members 32" effectively remain equidistantly spaced above the ground surface during operating conditions. Such a base member 31" also has a pair of oppositely seated central brackets 35 that are directly connected, without the use of intervening elements, to the leg members 32" and are medially seated therealong respectively.

The base member 31 further has a stabilizing lever 36 that has an elongated and rectilinear shape provided with axially opposed end portions 37 that are directly conjoined, without the use of intervening elements, to the leg members 32" respectively. Such a stabilizing lever 36 traverses the axis. The base member 31 further includes a plurality of upwardly protruding flanges 38" that are monolithically formed with the leg members 32" and are spaced adjacent to the end portions 34 thereof. Such flanges 38" are provided with hollow cavities 43 that are suitably sized and shaped for receiving the male portions 23 of grid members 20 therein, which is crucial such that the grid members 20 are effectively and conveniently maintained at vertical positions and remain directly rested, without the use of intervening elements, upon the leg members 32 during non-operating conditions.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A collapsible display rack for supporting a plurality of items at an elevated position, said display rack having a centrally registered longitudinal axis extending therethrough, said display rack comprising:

a plurality of vertically stacked grid members removably connectable to each other respectively, each of said grid members having a pair of oppositely spaced arms equidistantly spaced from the axis and extending parallel thereto, each of said grid members further including a central body having a mesh pattern, each of said central bodies being intermediately spaced between associated ones of said arms such that each of said central bodies spans across an entire distance between said arms respectively; and means for supporting said grid members at both a vertically stacked position and a vertically non-stacked position such that each of said grid members can be stored and transported at the non-stacked position during transport;

wherein said arms are directly connected to each other when said grid members are adapted to the stacked position, said arms being disconnected from each other when said grid members are adapted to the non-stacked position;

wherein selected ones of said arms have monolithically formed male and female portions formed therein, said male portions being telescopically and removably conjoined directly with said female portions when said grid members are adapted to the stacked position;

wherein said grid member supporting means comprises:

a base member having a plurality of rectilinear and elongated leg members oppositely and equidistantly spaced from the axis, said leg members being disposed parallel to each other and further being oriented parallel to a ground surface, said base member further having a plurality casters directly conjoined to axially opposed end portions of each of said leg members respectively such that said leg members remain equidistantly spaced above the ground surface during operating conditions, said base member further having a pair of oppositely seated central brackets directly connected to said leg members and medially seated therealong respectively, said base member further having a stabilizing lever having an elongated and rectilinear shape provided with axially opposed end portions directly conjoined to said leg members respectively, said stabilizing lever traversing the axis, said base member further including a plurality of upwardly and inwardly protruding flanges monolithically formed with said leg members and spaced adjacent to said end portions thereof, said flanges being suitably sized and shaped for receiving said grid members therebetween such that said grid members are maintained at vertical positions and remain directly at rest on said leg members during non-operating conditions.

2. A collapsible display rack for supporting a plurality of items at an elevated position, said display rack having a centrally registered longitudinal axis extending therethrough, said display rack comprising:

a plurality of vertically stacked and coextensively shaped grid members removably connectable to each other respectively, each of said grid members having a pair of oppositely spaced arms equidistantly spaced from the axis and extending parallel thereto, each of said grid members further including a central body having a mesh pattern, each of said central bodies being intermediately spaced between associated ones of said arms such that each of said central bodies spans across an entire distance between said arms respectively; and means for supporting said grid members at both a vertically stacked position and a vertically non-stacked position such that each of said grid members can be stored and transported at the non-stacked position during transport;

wherein said arms are directly connected to each other when said grid members are adapted to the stacked position, said arms being disconnected from each other when said grid members are adapted to the non-stacked position;

wherein selected ones of said arms have monolithically formed male and female portions formed therein, said male portions being telescopically and removably conjoined directly with said female portions when said grid members are adapted to the stacked position;

wherein said grid member supporting means comprises:

a base member having a plurality of rectilinear and elongated leg members oppositely and equidistantly spaced from the axis, said leg members being disposed parallel to each other and further being oriented parallel to a ground surface, said base member further having a plurality casters directly conjoined to axially opposed end portions of each of said leg members respectively such that said leg members remain equidistantly spaced above the ground surface during operating conditions, said base member further having a pair of oppositely seated central brackets directly connected to said leg members and medially seated therealong respectively, said base member further having a stabilizing lever having an elongated and rectilinear shape provided with axially opposed end portions directly conjoined to said leg members respectively, said stabilizing lever traversing the axis, said base member further including a plurality of upwardly and inwardly protruding flanges monolithically formed with said leg members and spaced adjacent to said end portions thereof, said flanges being suitably sized and shaped for receiving said grid members therebetween such that said grid members are maintained at vertical positions and remain directly at rest on said leg members during non-operating conditions.

3. A collapsible display rack for supporting a plurality of items at an elevated position, said display rack having a centrally registered longitudinal axis extending therethrough, said display rack comprising:

a plurality of vertically stacked and coextensively shaped grid members removably connectable to each other respectively, each of said grid members having a pair of oppositely spaced arms equidistantly spaced from the axis and extending parallel thereto, each of said grid members further including a central body having a mesh pattern, each of said central bodies being intermediately spaced between associated ones of said arms such that each of said central bodies spans across an entire distance between said arms respectively; and means for supporting said grid members at both a vertically stacked position and a vertically non-stacked position such that each of said grid members can be stored and transported at the non-stacked position during transport, wherein said grid member supporting means is completely detachable from said grid members and independently transportable therewith;

wherein said arms are directly connected to each other when said grid members are adapted to the stacked position, said arms being disconnected from each other when said grid members are adapted to the non-stacked position;

wherein selected ones of said arms have monolithically formed male and female portions formed therein, said male portions being telescopically and removably conjoined directly with said female portions when said grid members are adapted to the stacked position;

wherein said grid member supporting means comprises:

a base member having a plurality of rectilinear and elongated leg members oppositely and equidistantly spaced from the axis, said leg members being disposed parallel to each other and further being oriented parallel to a ground surface, said base member further having a plurality casters directly conjoined to axially opposed end portions of each of said leg members respectively such that said leg members remain equidistantly spaced above the ground surface during operating conditions, said base member further having a pair of oppositely seated central brackets directly connected to said leg members and medially seated therealong respectively, said base member further having a stabilizing lever having an elongated and rectilinear shape provided with axially opposed end portions directly conjoined to said leg members respectively, said stabilizing lever traversing the axis, said base member further including a plurality of upwardly and inwardly protruding flanges monolithically formed with said leg members and spaced adjacent to said end portions thereof, said flanges being suitably sized and shaped for receiving said grid members therebetween such that said grid members are maintained at vertical positions and remain directly at rest on said leg members during non-operating conditions.

* * * * *